US006886447B2

(12) United States Patent
Crotty et al.

(10) Patent No.: US 6,886,447 B2
(45) Date of Patent: May 3, 2005

(54) HATCH ASSEMBLY

(75) Inventors: Jeffrey Crotty, Coon Rapids, MN (US); Stephen Sohm, Plymouth, MN (US)

(73) Assignee: United Defense, L.P., Arlington, VA (US)

( * ) Notice: Subject to any disclaimer, the term of this patent is extended or adjusted under 35 U.S.C. 154(b) by 16 days.

(21) Appl. No.: 10/448,749

(22) Filed: May 30, 2003

(65) Prior Publication Data

US 2004/0237764 A1 Dec. 2, 2004

(51) Int. Cl.[7] ..... F41H 5/26
(52) U.S. Cl. ..... 89/36.14; 89/36.12
(58) Field of Search ..... 89/36.14, 36.12

(56) References Cited

U.S. PATENT DOCUMENTS

| | | | | |
|---|---|---|---|---|
| 3,724,323 A | | 4/1973 | Selle | |
| 3,821,935 A | | 7/1974 | Adler | |
| 4,587,880 A | | 5/1986 | Sprafke et al. | |
| 4,646,616 A | | 3/1987 | Svensson | |
| 4,854,076 A | * | 8/1989 | Sieben et al. | 49/280 |
| 4,929,019 A | * | 5/1990 | Paakkonen et al. | 296/223 |
| 5,105,714 A | | 4/1992 | Sprafke et al. | |
| 5,105,718 A | | 4/1992 | Sprafke et al. | |
| 5,128,803 A | | 7/1992 | Sprafke | |
| 5,220,127 A | | 6/1993 | Tiomkin et al. | |
| 5,353,680 A | * | 10/1994 | Tiomkin et al. | 89/37.03 |
| 5,408,783 A | | 4/1995 | Sprafke et al. | |
| 6,196,590 B1 | * | 3/2001 | Kim | 280/830 |
| 6,293,051 B1 | | 9/2001 | Matye | |

* cited by examiner

*Primary Examiner*—Michael J. Carone
*Assistant Examiner*—Troy Chambers
(74) *Attorney, Agent, or Firm*—Patterson, Thuente, Skaar & Christensen, P.A.

(57) ABSTRACT

A hatch assembly and method for using the same that allows for enhanced ease of ingress and egress through a portal of a military vehicle. The hatch is advanced and cleared away from the portal through use of a hatch operating mechanism that employs an extendable cylinder assembly to advance the hatch and a rotational assembly operably connected to the telescopic assembly to rotate the hatch so as to clear the portal.

21 Claims, 11 Drawing Sheets

HATCH ASSEMBLY

GOVERNMENT INTEREST

The U.S. Government has a paid-up license in this invention and the right in limited circumstances to require the patent owner to license others on reasonable terms as provided for by the terms of Contract No. DAAE 30-95-C-0009 awarded by the U.S. Army.

FIELD OF THE INVENTION

The present invention relates generally to a hatch and in particular to a pivoting hatch assembly for armored military vehicles.

BACKGROUND OF THE INVENTION

Hatches provide access to a generally sealed environment such as areas of a ship, tanker trailers, bunkers, and military vehicles. Such hatches must be constructed to meet the same structural requirements as the surrounding structure. Furthermore, the hatch must maintain the integrity of the sealed environment when locked down.

Traditional hatches open and close by pivoting along one edge of the hatch. Examples of conventional hatches are disclosed in U.S. Pat. No. 4,424,736 to Byrne; U.S. Pat. No. 6,293,051 to Matye; U.S. Pat. No. 5,137,327 to Edmonds et al.; and U.S. Pat. No. 5,220,127 to Tiomkin et al. The one-sided hinge has particular design advantages, but requires an unobstructed envelope for completing the hatch pivot. This becomes problematic when the barrel of a cannon or other object is in close proximity to the hatch. Therefore, there is a need for a hatch with a minimal opening envelope that does not interfere with other structures.

The structural requirements for a hatch frequently make them difficult to open. One of the main purposes of a tank hatch is to facilitate the movement of military personal, while providing the same level of protection as the rest of the tank structure. Depending upon the vehicle or embodiment, any particular hatch may include armor. Additional "top-attack" armor is commonly used to enhance protection when a vehicle is within a particularly high threat area. These survivability requirements drastically increase the weight of the hatch adding to the difficulty of operating the hatch.

Many traditional hinge assemblies utilized torsional springs to reduce the force required to open the side pivot hatch assemblies. Armor for the hatch of a tank, however, can be relatively heavy, and the torsion springs would have to be relatively large to be effective. Spring size would necessarily be further increased if top attack armor was used. However, large springs are bulky and impinge on the already limited interior working space. Furthermore, once the removable armor is taken off there is considerably less weight to the hatch, which in turn could create a potentially dangerous uncontrolled opening of the hatch due to the larger springs.

A hatch should be relatively easy to function, while remaining reliable. In a military vehicle, reliability must be maintained through rigorous and damaging conditional. The hatch of a military vehicle should accommodate the addition and removal of armor. The steps needed to open and close the hatch portal should be minimal, taking into consideration the amount of force and time needed to operate the hatch during emergencies. It would be desirable to have a hatch assembly in which the user can retain positive control over opening and closing. Further, opening the hatch should require as small an opening envelope as possible so as not to interfere with other operating features of the vehicle, such as a gun barrel or a military vehicle.

SUMMARY OF THE INVENTION

The improved hatch assembly in accordance with the present invention is particularly advantageous for use with any portal in which the weight of the hatch requires positive control over opening and closing operations and the area transverse to the opening is limited. The hatch assembly of the present invention is specifically appropriate for a portal on a military vehicle where armor adds to the weight of the structure. The hatch assembly includes a base plate which frames the portal, a hatch lifting mechanism supported by the base plate and a hatch which is mounted to the hatch lifting mechanism. The hatch is raised and lowered by way of a rotating telescopic assembly wherein the entire hatch is raised off the portal and then rotated away from the portal.

In a first embodiment, the hatch lifting mechanism comprises two telescoping tube sections comprised of an inner and outer cylinder with a ball screw connecting the two. The top of the inner cylinder is connected to the hatch and the bottom of the outer cylinder is connected to the base plate. The inner cylinder is advanced or retracted with regret to the outer cylinder when the ball screw is actuated by rotating either the interior or exterior handle. The outer cylinder has a cam attached to its outer face through the hatch. The cam rides in a cam slot as the cylinders are telescoping relative to each other. Thus, the hatch rotates in relation to the base plate.

The operator disengages the securing device and rotates one of the crank handles to open the hatch. The crank handles cause the splined shaft disposed within the ball screw to rotate, rotating the ball screw, and telescopically moving the inner cylinder with respect to the outer cylinder. Alternatively, a straight spline, involute spline, recalculating balls, keyed shaft or polygonal shaft, can also control vertical displacement. During rotation of the ball screw, the cam follower, which is attached to the outer cylinder, causes rotational displacement. The number of handle turns required to fully open or close the hatch is dependent upon the size of the drive sprocket. A locking device automatically engages to prevent premature movement of the hatch when the hatch reaches the fully opened position. The user may disengage the locking device and perform the steps in reverse order to close the hatch.

BRIEF DECRIPTION OF THE DRAWINGS

FIG. 1 is a perspective view of the front end of a military vehicle incorporating a hatch in accordance with the present invention;

FIG. 2*a* is a perspective view of the hatch assembly in the closed position;

FIG. 2*b* is a perspective view of the hatch assembly in the open position;

Figure 5A:
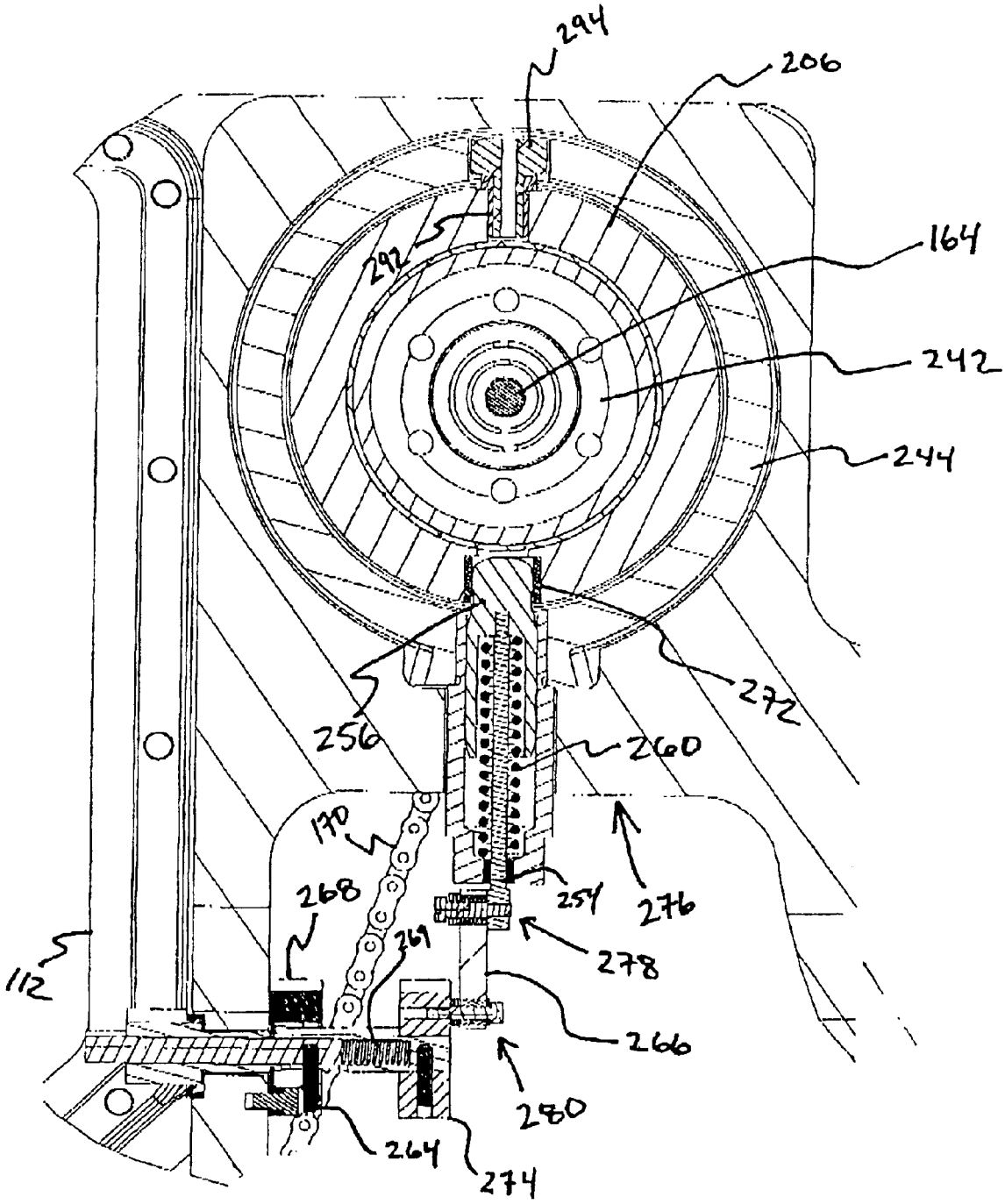
Figure 5B:
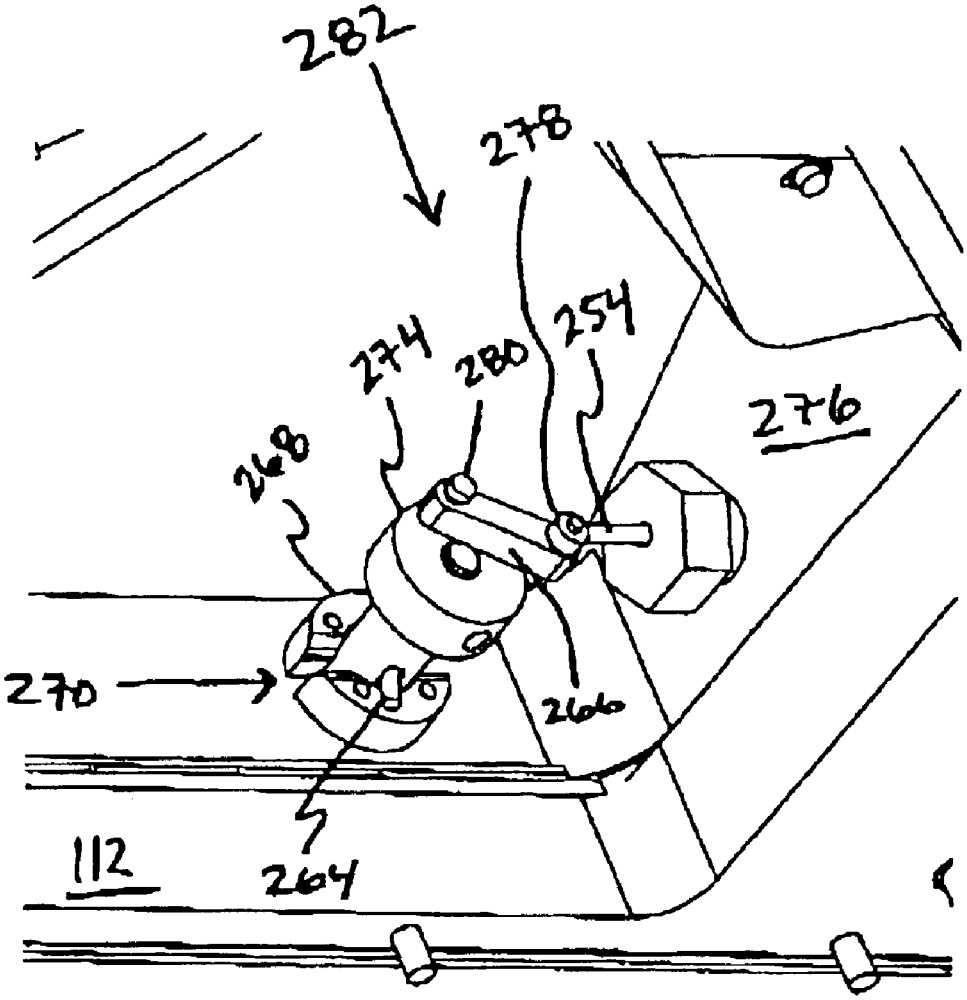
Figure 5C:
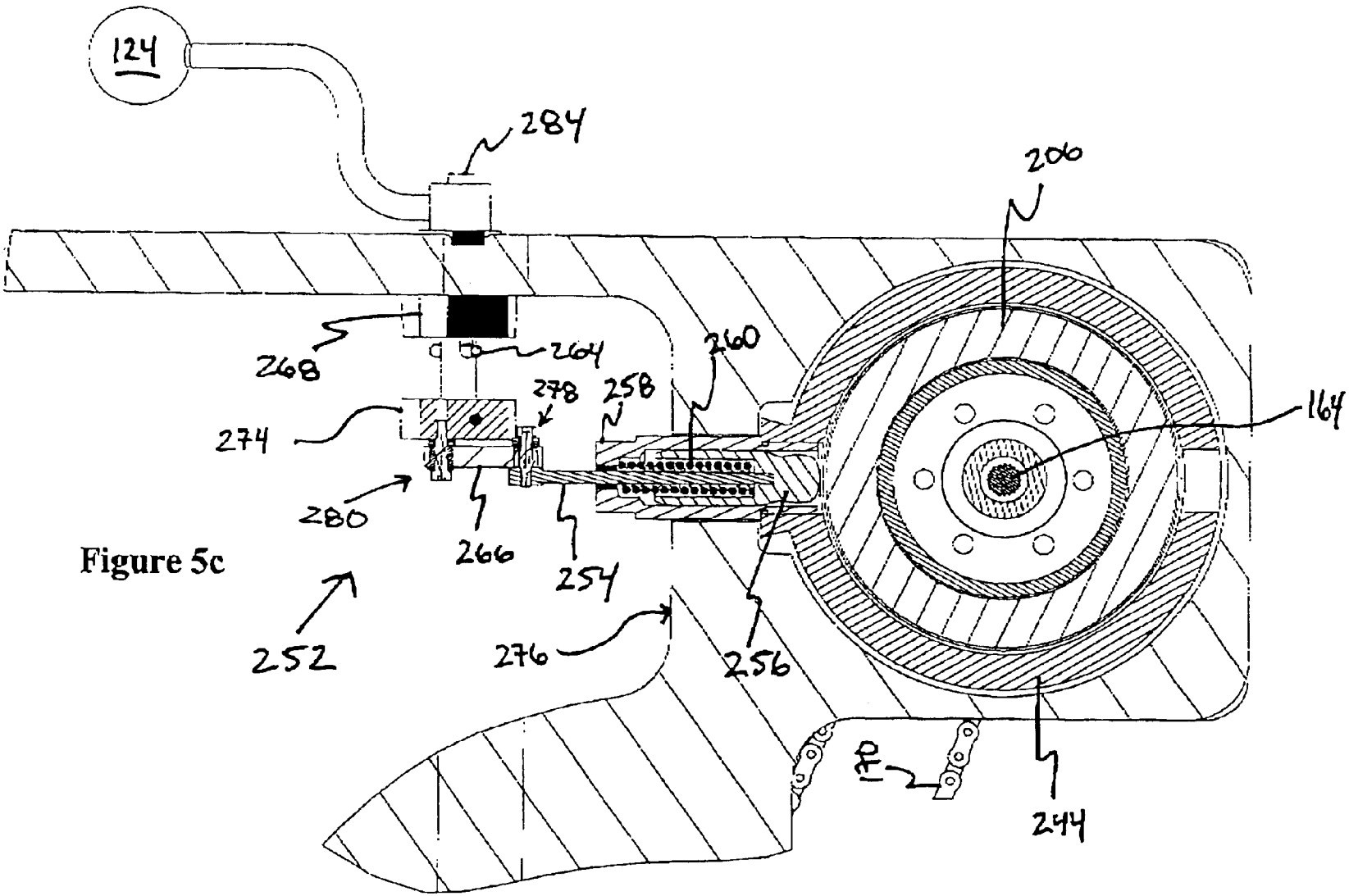
Figure 6:
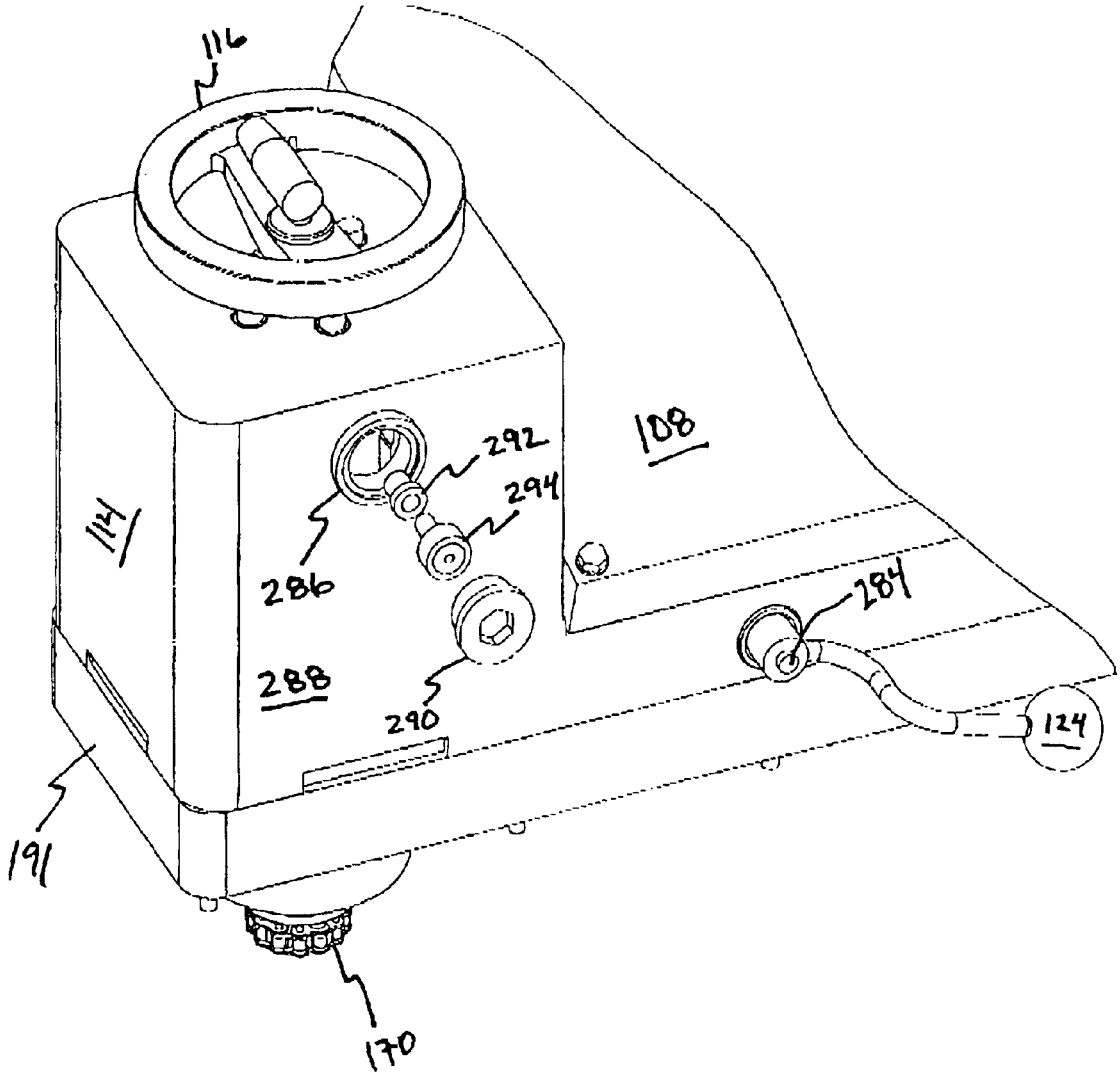
Figure 7:
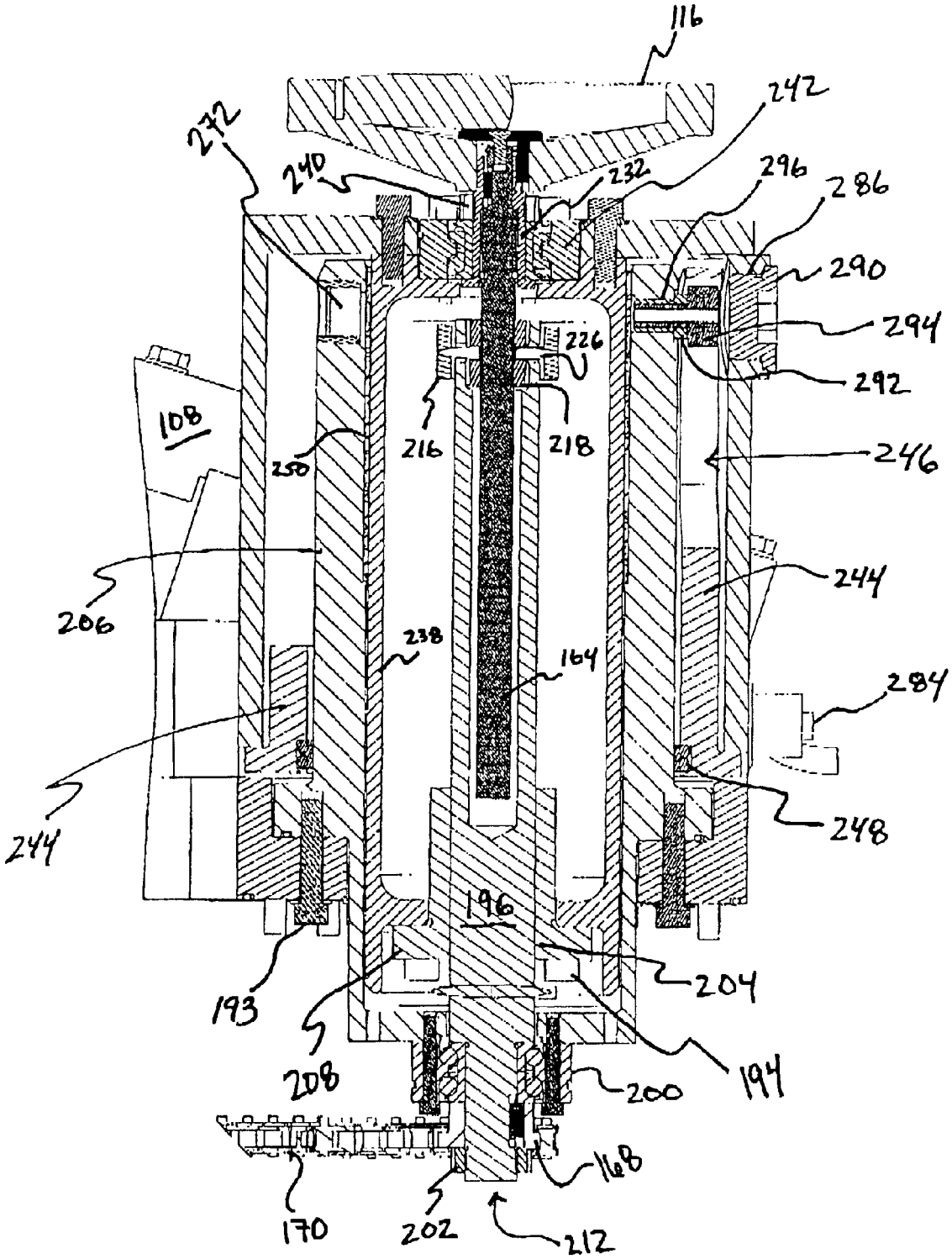
Figure 8:
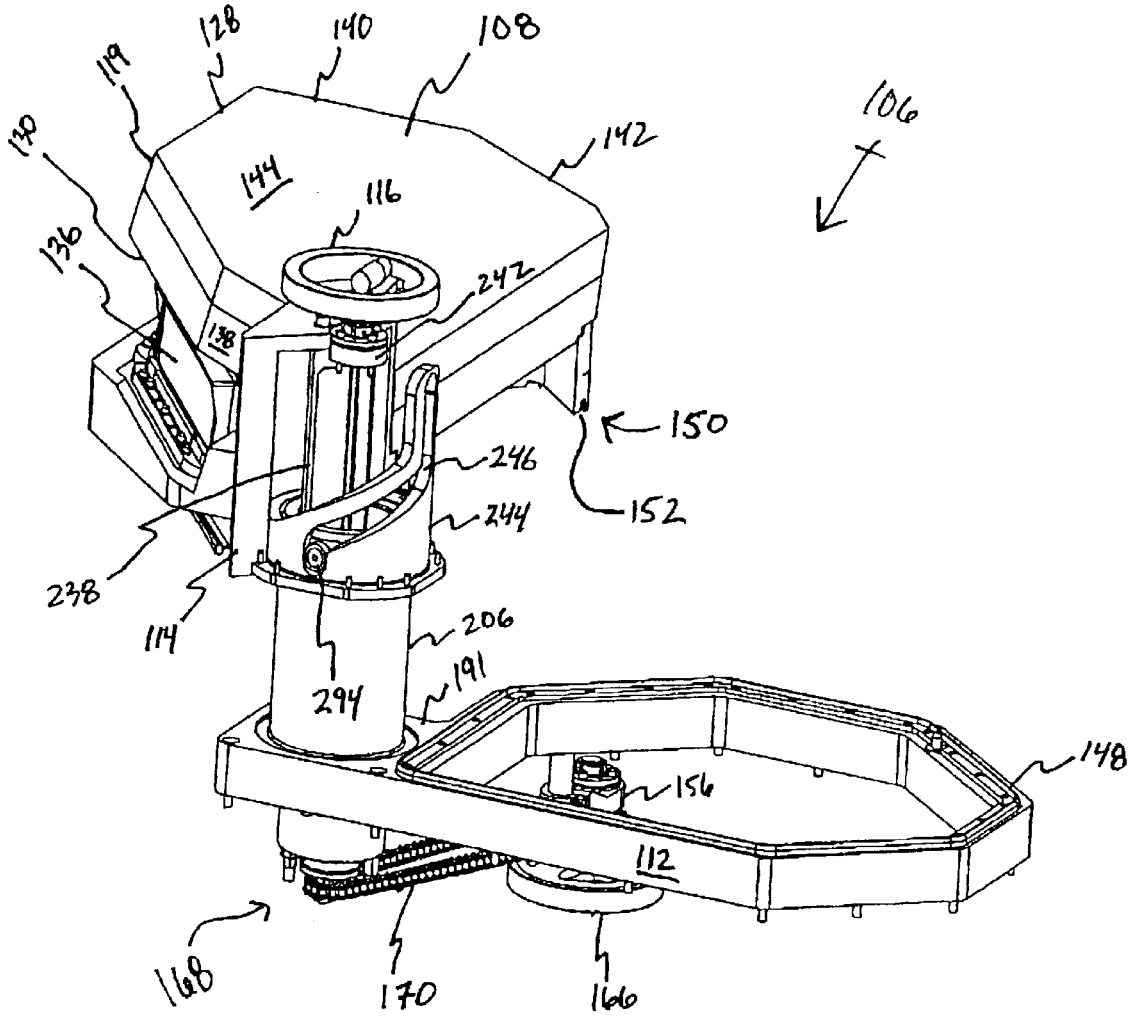

FIG. 5*a* is a cross-sectional top view of the cylinder assembly and the locking mechanism with the hatch in the open position, cut axially through the hatch pin;

FIG. 5*b* is a perspective view of the locking mechanism;

FIG. 5*c* is a cross-sectional top view of the cylinder assembly and locking mechanism with the hatch in the closed position cut axially through the hatch pin;

FIG. 6 is a perspective view of the tower, showing an exploded view of the cam elements;

FIG. 7 is a cross-sectional side view of the cylinder assembly with hatch closed cut axially through the cam follower; and FIG. 8 is a perspective view of the hatch assembly in the open position, with the rear end of the tower and the hatch removed to present the hatch insert.

DETAILED DESCRIPTION OF THE DRAWINGS

Figure 1:
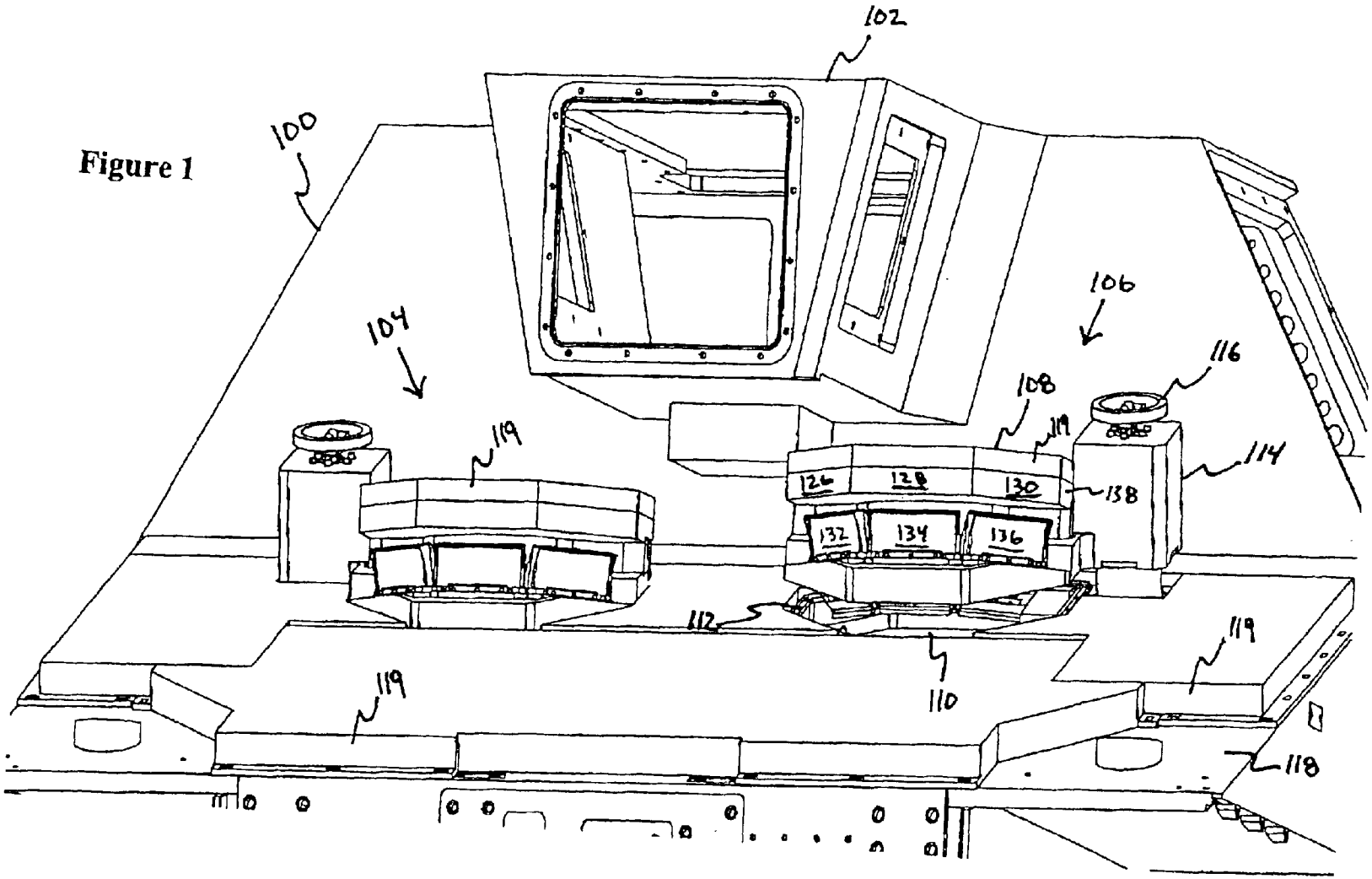

FIG. 1 is a perspective view of a portion of military vehicle 100 shown with extension compartment 102 representing the placement of a cannon or reloading aperture. Situated beneath the extension compartment 102 are hatch assemblies 104 and 106. Extension compartment 102 protrudes over hatches 104 and 106, presenting geometric restrictions which preclude the use of simple hinge mechanisms for the hatch 104 and 106.

Hatch assembly 106 covers portal 110. Portal 110 provides access into the vehicle 100. The front end 118 of the military vehicle 100 is depicted with removable top-attack armor 119. The top-attack armor 119, which increases the weight of hatch 108, is often applied to military vehicles prior to insertion into high-risk environments.

Figure 2A:
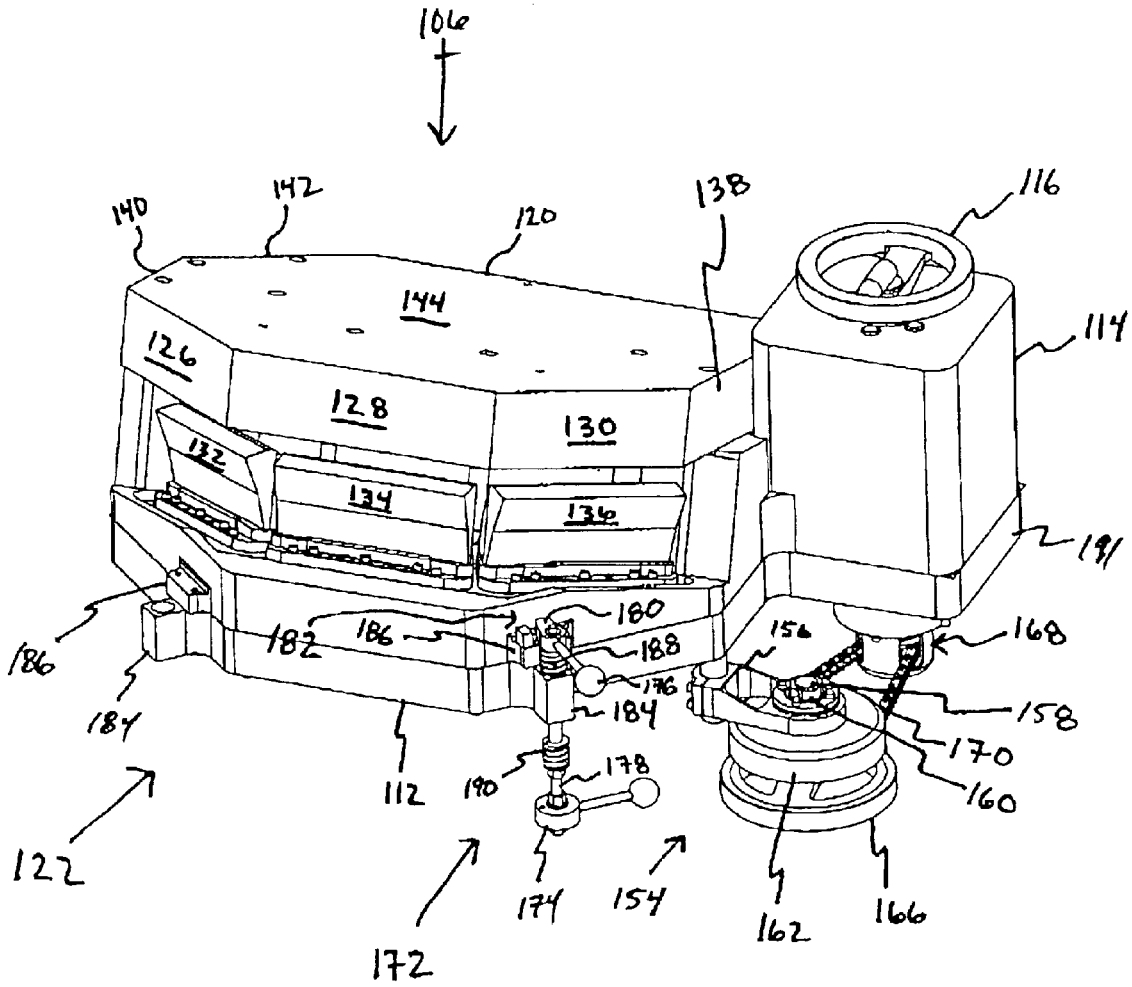
Figure 2B:
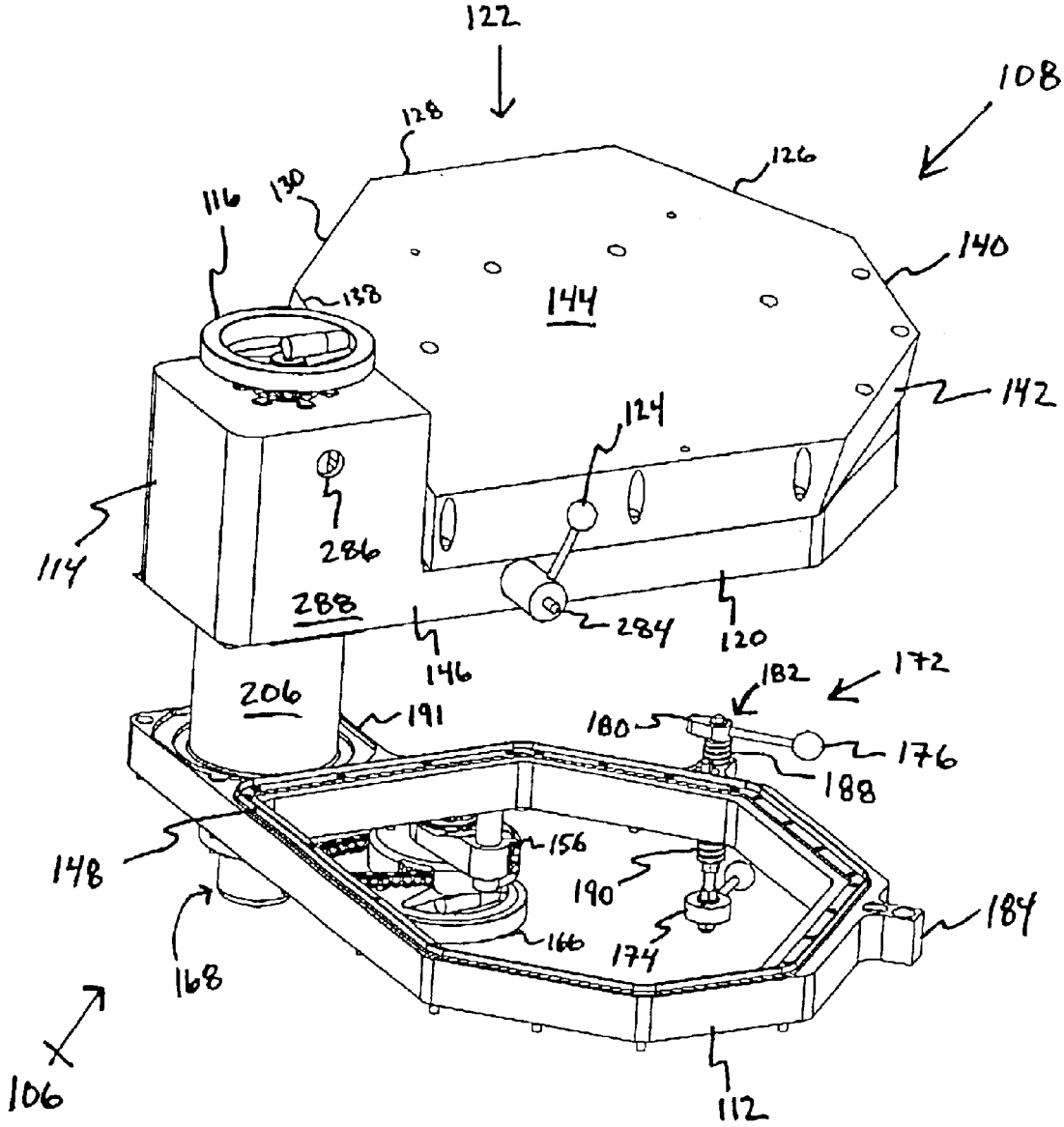

As illustrated in FIGS. 2*a* and 2*b*, hatch assembly 106 comprises a hatch 108, a base plate 112 and a lifting tower 114. Base plate 112 forms a frame around the portal 110 and is disposed within the vehicle 100. The hatch 108 is raised and lowered by lifting tower 114, which connects base plate 112 to hatch 108. While in the closed position, the hatch 108 is in direct communication with the base plate 112.

Hatch 108 of the present invention has a rear face 120 and a front face 122 relative to the front and rear of vehicle 100. The hatch 108 has a trapezoidal shape and is constructed of aluminum or other suitable metal. An external release lever 124 extends outward from the rear face 120 of hatch 108. The front face 122 of hatch 108 consists of three relatively vertical panels 126, 128 and 130 with integrated periscopes 132, 134 and 136 providing generally forward viewing when hatch 108 is in a closed position. The periscopes 132, 134 and 136 are designed to aid in viewing the external environment from the safety of the military vehicle. Positioning of the periscopes 132, 134 and 136 on the hatch 108 is convenient for the user and is an efficient use of space.

The hatch 108 is fixedly attached to the lifting tower 114 at tower side 138. The tower side 138 is adjacent to side panel 130 and rear face 120. Opposite tower side 138 are distal sides 140 and 142. Hatch 108 is further comprised of a top layer 144 which rests on lower layer 146. The top layer 144 extends distally from the rear end 120 at an upward angle relative to the base plate 112 in a first embodiment. The slope of front-end 118 is determined by numerous factors, including the angle of incidence with an incoming round and ergonomic look-down angle. The look-down angle is the natural line of sight for the user without eye strain, fatigue, or head movement. The upward slope in the preferred embodiment is approximately twenty degrees.

FIGS. 2*a* and 2*b* illustrate the relationship between the hatch 108 and base plate 112 in open and closed positions. As illustrated in FIG. 2*a*, the internal crank handle mechanism 154 is fixedly attached to the base plate 112 by an extension arm 156. A mounted bearing 158 and lock nut 160 rigidly fix the extension arm 156 to the internal crank handle mechanism sprocket 162. The internal crank handle mechanism sprocket 162 is operably attached to the internal crank handle 166. Tower sprocket 168 is connected to internal crank handle mechanism sprocket 162 by rotation chain 170. The particular design of the present invention allows for complete pre-assembly of the hatch assembly 106, absent the chain 170.

The internal crank handle 166 and the external crank handle 116 located on exterior face of lifting tower 114 are used for actuating the hatch assembly 106. The internal crank handle 166 is connected to a chain 170. The particular position of the handle 166 within the military vehicle 100 makes actuation difficult without the chain 170. In an alternative embodiment (not shown), the chain may be removed and the internal crank handle may be directly connected to the cylinder assembly in a similar fashion as the external crank handle 116.

The sprockets 168 and 162 may be of varying sizes depending upon the desired result. Differing ratios between the sprockets 162 and 168 can result in a hatch assembly 106 that requires less force to actuate, but requires more turns of the handle 166 to open or close the hatch 108. Alternatively, a greater force may be necessary to turn the handle 166, but fewer turns would be necessary to open or close the hatch 108 due to the ratio between the two sprockets.

It is advantageous to have a securing device 172 to securely fasten the hatch 108 to base plate 112. The securing device 172 has an internal handle 174 and an external handle 176. The internal handle 174 and the external handle 176 extend radially from the pivot rod 178. A securing node 180 is fixedly attached to the external handle 176, in which they spin as one unit. The pivot rod 178 axially extends through the securing device arm 184. The securing device arm 184 is fixedly attached to the base plate 112. A receiving plate 186, attached to the hatch 108, provides a seat for the securing node 180.

Springs 188 and 190 frictionally maintain the connection between the securing node 180 and the receiving plate 186. An external spring 188 is axially inserted about the pivot rod 178 between the upper joint 182 and the securing device arm 184. An internal spring 190 is axially inserted around the pivot rod 178 between the securing device arm 184 and the internal handle 174.

There may be more than one securing device 172 for each hatch assembly 106. Here, the securing device 172 is positioned proximal to the front end 122. Alternatively, a securing device may also be located proximal to the tower base 191. The securing device 172 will assist in maintaining a tight seal between the base plate 112 and the hatch 108. This is particularly useful while the military vehicle 100 is in motion or under attack. The securing device 172 may be operated from the inside or the outside of the vehicle 100. Additional mechanical fastening devices may be implemented for the same purpose such as spring-loaded clamps, hooks or other similar devices.

Figure 3:
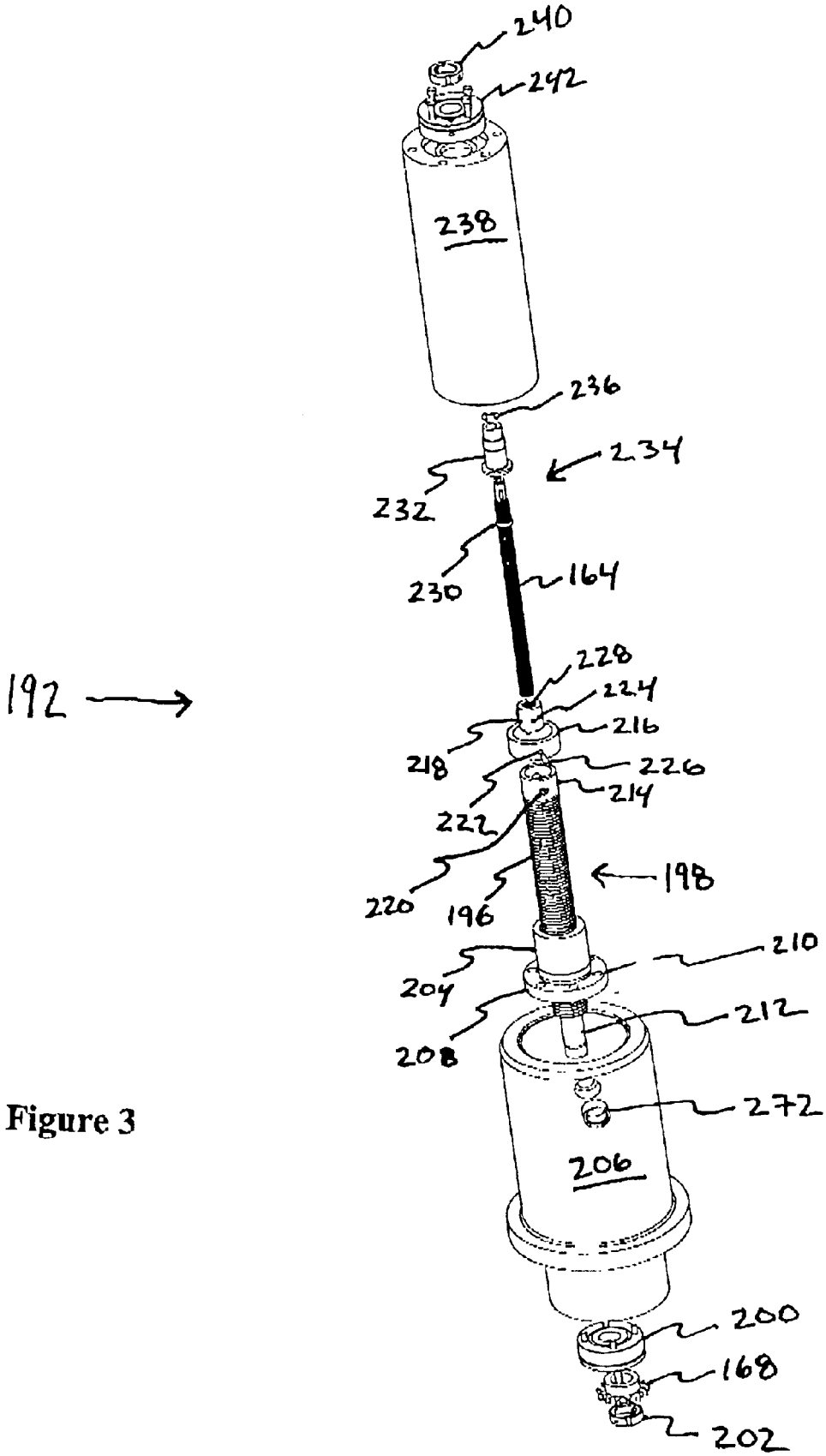
FIG. 3 is an exploded view of the cylinder assembly.

Hatch 108 is operated by rotating either interior handle 166 or exterior handle 116. Then handles 166 and 116 are operably connected to cylinder assembly 192 as illustrated in FIG. 3. The cylinder assembly 192 contains a ball screw 196, a ball screw nut 204, a splined shaft 164, an outer cylinder 206, and an inner cylinder 238. The splined shaft 164 is partially contained within and fixedly attached to the ball screw 196. The ball screw 196 threadably engages ball screw nut 204, which is then fixed to the inner cylinder 238. The inner cylinder 238 is in telescopic communication with the outer cylinder 206. The base of the outer cylinder 206 is fixedly attached to tower base 191 and the top of inner cylinder 238 is fixedly attached to hatch 108.

The ball screw 196 is an elongated hollow, cylindrical metal structure. The ball screw nut 204 moves up or down the threaded mid-section 198 of the ball screw 196 depending upon the direction of rotation. Axial rotation of the ball screw 196 is caused by axial rotation of the splined shaft 164.

A splined bushing 218 and splined shaft 164 are employed to allow relatively free vertical motion, while restricting rotational motion. The splined shaft 164 is an elongated cylindrical metal structure. The inside wall 228 of the splined bushing 218 is adapted so as to receive the splined shaft 164 so that they rotate axially together. The splined bushing 218, however, is also free to slide up and down the splined shaft 164.

The splined bushing 218 functions to increase operational longevity. The splined bushing 218 is easier and cheaper to replace than splining the ball screw 196 to accept the splined shaft 164. Additionally, cutting an interior spline into the ball screw 196 would lose many of the advantages afforded by the "floating" bushing 218. However, the splined bushing 218 is not necessary, and alternative embodiments may function without the bushing 218.

The splined shaft 164 is embedded into the ball screw 196. Splined shafts are desirable over keyed shafts because they are more reliable and the torque transfer is higher. Keyways also wear out over time when compared to splines, especially when considering the "sliding" action that takes place between the shaft and bushing. Alternatively the splined shaft 164 may be an involute spline (not shown) rather than a straight spline, or a polygonal shaped shaft (not shown).

An O-ring 230, proximal to the shaft adapter 232, is axially inserted on the splined shaft 164. The O-ring 230 is manufactured from rubber or an alternative material suitable for creating a seal. The shaft adapter 232 is fixedly attached to the top end 234 of the splined shaft 164 and held in place by snap ring 236. Shaft adapter 232 extends axially through lock nut 240 and mounted bearing 242, which are fixedly attached to the ball screw 196 and the inner cylinder 238 respectively.

Attached to the top end 214 of the ball screw 196 are bushing retainer 216 and splined bushing 218. The bushing retainer 216 is a hollow metal ring structure that slideably fits around the top end 214 of the ball screw 196. The bushing retainer 216 contains a pair of opposing bushing retainer apertures 222. The splined bushing 218 is cylindrical in shape and includes a pair of opposing bushing apertures 224. The top end 214 of ball screw 196 also contains a pair of opposing apertures 220. The ball screw 196, bushing retainer 216, and bushing 218 are positioned so that the respective apertures 220, 222, 224 line-up for insertion of a dowel 226. The dowel 226 acts as a positive stop for the travel of the ball screw nut 204.

The splined bushing 218 and the splined shaft 164 must be in tight communication with each other in order for the torque to be transferred to the ball screw 196. Two dowels 226 are used to maintain this relationship. The clearance between dowels 226 and the apertures 220 in the ball screw 196 allows the splined bushing 218 to "float". The tight communication between the dowels 226, the splined bushing 218, and bushing retainer 216 ensure that the dowels 226 are captured and not free to fall out. A single continuous dowel that extends through the shaft 164 is not used so as not to interfere with the free movement of the splined shaft 164. However, the use of two dowels 226 is not crucial. Alternative embodiments may contain a single dowel or any other effective retention method for the designed purpose.

The ball screw nut 204 is fixed to the inner cylinder 238 through use of a nut flange 208 in order for the cylinder assembly 192 to telescopically move. A plurality of equally spaced apertures 210 are positioned radially on the nut flange 208. The apertures 210 receive bolts 194 (See FIG. 4), which are fixedly attached to the inner cylinder 238.

Figure 4:
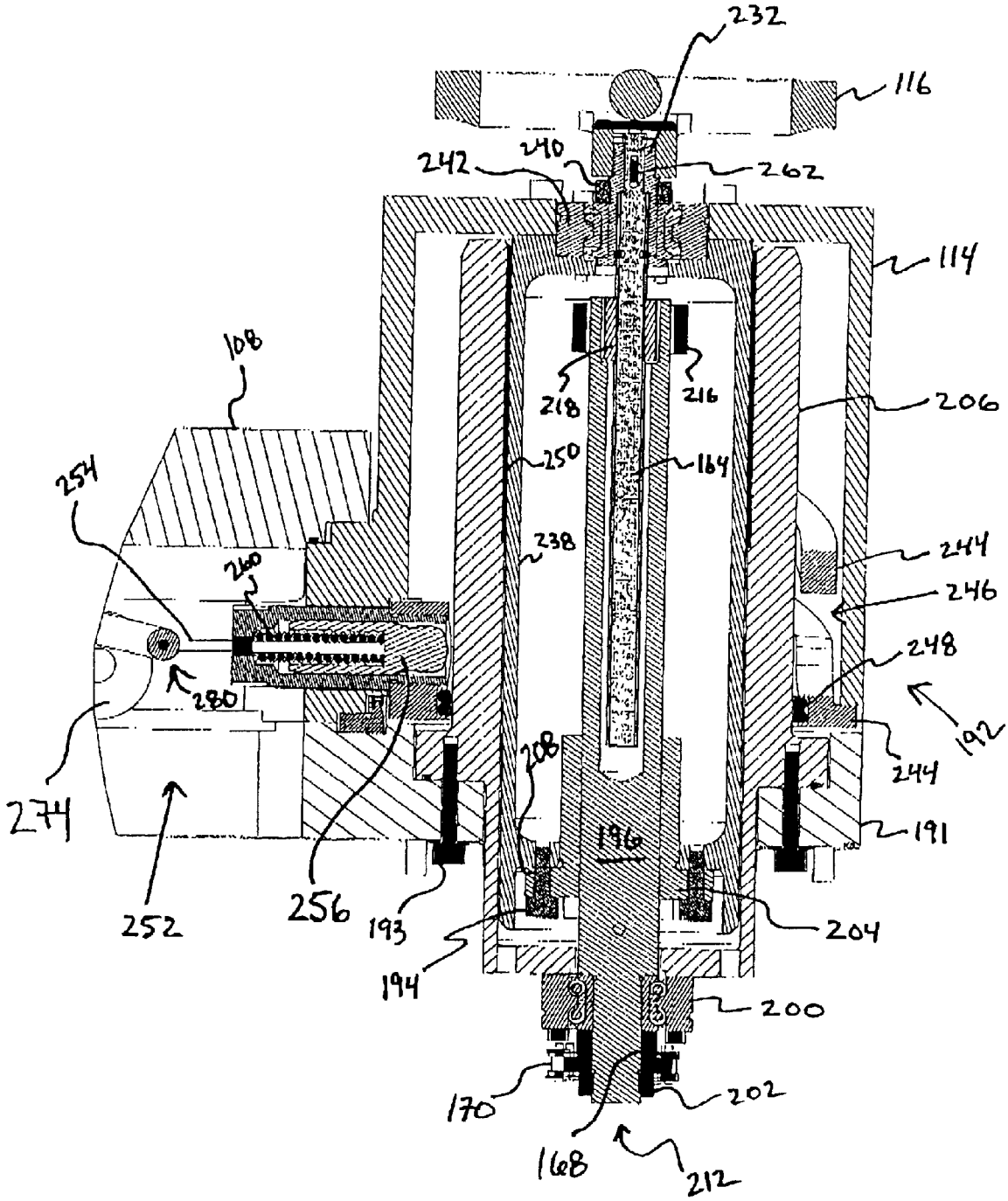
FIG. 4 is cross sectional side view of the cylinder assembly cut axially through the hatch pin.

Now referring to FIG. 4, the lifting tower 114 is shown with the hatch 108 in the closed position. An exterior crank handle 116 is centrally positioned on the top of the tower 114 and fixedly attached to the shaft adapter 232. Hatch insert 244 surrounds the outer cylinder 206 and is positioned between the outer cylinder 206 and the tower 114. Hatch insert 244 forms the helical cam path 246. Shaft 212, attached to ball screw 196, extends through bearing 200 to engage sprocket 168 and lock nut 202 at the opposing end of lifting tower 114.

Positioned between the hatch insert 244 and the outer cylinder 206 is a seal 248 to keep contaminants from entering the interior of the vehicle 100 and the hatch tower 114 while the hatch assembly 106 is closed. Conventional rubber or similar materials have been found particularly suitable for the seal 248. The seal 248 is positioned circumferentially around the outer cylinder 206, proximal to the base 191 of the tower 114. As a result of the considerable movement between the inner cylinder 238 and the outer cylinder 206, a bushing 250 is inserted to increase operational life.

A shaft adapter 232 is employed, enabling the external crank handle 116 to be fixedly attached to the splined shaft 164. A square key 262 is utilized to maintain this fixed relationship between the shaft 164 and the handle 116. The square key 262 is positioned on the top end 234 of the splined shaft 164.

A loose fit between the ball screw 196 and the splined bushing 218 enables pivoting and alignment of the crank handle 116. The square key 262 is designed and positioned to stop rotation between the shaft adapter 232 and the splined shaft 164. This necessarily creates a more direct transfer of torque from the exterior crank handle 116 to the ball screw 196. An O-ring 230 is placed over the splined shaft 164 to inhibit contaminants from penetrating the vehicle when the hatch 108 is closed.

A locking mechanism 252 is illustrated in FIGS. 4, 5*a*, 5*b*, and 5*c*. The hatch pin 256 is spring loaded. Once the hatch assembly 106 reaches the fully open position the hatch pin 256 automatically extends into the pin receptacle 272 of outer cylinder 206. The hatch pin 256 is substantially cylindrical in shape and is contained within a pin housing 258. The pin housing 258 is contained within the tower sidewall 276. A rod arm 254 penetrates the pin housing 258. The rod arm 254 is threadably attached to the hatch pin 256. The hatch pin 256 is attached to the rod link 266 at the pin hinge point 278. The knob link hinge 280 distally positioned from the hinge point 278. The rod link 266 is hingingly attached to the pin knob 274 at link hinge 280. The pin knob 274 extends through the rear end 120 of the hatch 108. The locking mechanism 252 is essentially internally contained within the hatch assembly 106 at hatch assembly corner 282, with the exception of the external release handle 124, hatch pin 256, pin housing 258, and spring 260. A detent 284 is provided to release the locking pin 264 from the clamshell insert 270 in order to allow for the hatch pin 254 to be released. The detent 284 is positioned on the external release lever 124.

Now referring to FIGS. 6 and 7, an access aperture 286 covered by plug 290 is positioned in the rear side 288 of the tower 114. A threaded insert 292 is fixedly attached to the outer cylinder 206. A cam follower 294, inserted into the threaded insert 292, extends distally from the outer cylinder 206 and is positioned in the cam path 246 of the hatch insert 244.

The pin receptacle 272, shown in FIG. 7, is an aperture cut out of the outer cylinder 206. Positioned on the opposite side of the outer cylinder 206 from the pin receptacle 272 is the threaded insert aperture 296 for the cam follower 294. The threaded insert aperture 296 is cut out of the outer cylinder 206. Positioned within the aperture 296 is the threaded insert 292. The pin receptacle 272 and the threaded insert aperture 296 are positioned in the outer cylinder 206 proximal to the external crank handle 116.

FIG. 8 depicts the cam follower 294 positioned within the cam path 246. The hatch 108 is in the open position and the hatch pin 256 (see FIG. 5*a*) is in the locked position. The hatch insert 244 is shown as a partial cylindrical form around the outer cylinder 206. Alternatively, the hatch insert 244 may be substantially cylindrical with the cam path 246 cut out, rather than the minimalistic form represented in FIG. 8.

FIG. 8 depicts the hatch in the open position. The cut away view clearly shows the position of the cam follower 294 in the cam path 246. The cam path 246 forms an elongated helical or s-shape. This particular form allows for the vertical displacement at both ends of the opening/closing cycle as well as the simultaneous vertical-rotational displacement through the middle of the opening/closing cycle.

The user will commonly desire to open the hatch 108, as its default position is the closed position. The user will disengage the securing device 172. Next, the user will rotate either the internal crank handle 166 or the external crank handle 116, depending upon whether the user is inside or outside the vehicle 100. Rotation of either handle 116, 166 will actuate the cylinder assembly 192. The inner cylinder 238 moves with respect to the outer cylinder 206 in a telescopic manner. While this motion is occurring the cam follower 294, which is mounted into the outer cylinder 206, moves along cam path 246. This in turn causes the lifting and rotating motion of the hatch 108.

Once the hatch 108 reaches the fully open position the locking pin 264 engages preventing the premature closing of the hatch 108. Constant tension is placed upon the hatch pin 256 by the spring 260. As the pin 256 engages the pin receptacle 272, the rod link 266 causes the pin knob 274 to rotate, which in turn causes the locking pin 264 to engage the clam shell insert 270. The locking pin 264 extends outward from the locking pin rod 265. The locking pin rod 265 is spring loaded by spring 269. As the locking pin 264 engages the clamshell insert 270 the locking pin rod 269 slidably moves distally in relation to the pin knob 274, proximal to the detent 284. The detent 284 extends outward from the base plate 112 when the hatch pin 256 engages the pin receptacle 272. Depressing the detent 284 compresses the spring 269 and causes the locking pin 264 to disengage from the clamshell insert 270. Depressing the detent 284 followed by a rotation of the external release lever 124 causes the pin knob 274 to rotate, and thereby causing disengagement of the hatch pin 256 from the pin receptacle 272. The external release lever 124 must be engaged to release the locking pin 264 and allow the hatch 108 to close.

A sealing system includes a ridge 148 designed to fit in tight communication with a recess 152. Whether the ridge 148 is on the base plate 112 or whether the recess 152 is on the base plate 112 does not matter, as long as one of them is on the base plate 112 and the other is on the hatch 108. The tight communication between the ridge 148 and the recess 152 allows for a functional seal preventing external debris and contaminants from entering the portal.

The crank handles 116, 166 may be manually rotated or a motor (not shown) actuates the hatch 108 opening. The opening procedure begins by lifting the hatch vertically above the surface of the military vehicle 100. The base plate 112 is flush with respect to the surrounding surface of the military vehicle. However, the presence of top attack armor 119 necessitates a greater clearance prior to beginning the rotational displacement of the hatch 108. (See FIG. 1). The vertical distance required is dependent upon the exact specifications of the hatch assembly 106, but approximately three (3) inches has been found particularly well suited for the present embodiment.

Transverse motion of hatch 108 is followed by a simultaneous rotation and lifting and then a final transverse travel. The final transverse motion is included to make alignment between the locking pin 264 and the pin receptacle 272 easier from a manufacturing standpoint, since the pin 264 would not have to find the receptacle 272 while on the helical cam path. The lifting and rotating allows for the hatch to be displaced in such a manner as to avoid undesirable interaction with other systems. The hatch insert 244 and cam path 246 guide the lifting and rotating. The presence of each of these allows for a smooth guided motion. This is particularly useful in the preferred embodiment where there is no motor used for actuation of the lifting. Such a motion aids individuals in opening and closing the hatch 108 in a safe and easy manner.

In an alternative embodiment, a hatch insert 244 may not be necessary if the weight of the hatch is reduced (i.e. a hatch without armor). The structural integrity of the cylinder assembly 192 is thus not as great of a concern as it is with the presence of heavy armor. Therefore, the cam path 246 can be cut directly into the outer cylinder 206.

The hatch assembly 106 is depicted with significant armor. However, armor is not necessary for the function of the hatch assembly 106. The preferred embodiment is designed to be easily adaptable to non-armored vehicles and containers without change.

It should be understood that the described and disclosed embodiment is merely exemplary of the invention and that all modifications are intended to be included that do not depart from the spirit of the invention and the scope of the appended claims.

What is claimed is:

1. A hatch assembly for a portal of an armored vehicle, the hatch assembly comprising:

a structure defining the portal in the armored vehicle;

a hatch positionable over the portal;

a hatch operating mechanism operably coupled to said hatch for shifting said hatch between a first position covering said portal and a second position clearing said portal, said hatch operating mechanism including an extendable assembly, presenting an extendable assembly axis, for initially advancing said hatch from said portal, and a rotational assembly for clearing said portal, wherein travel of the extendable assembly to the second position results in a hatch transverse displacement of less than one hatch diameter.

2. The hatch assembly of claim 1 further comprising an airtight seal assembly between the hatch and the armored vehicle.

3. The hatch assembly of claim 1 further comprising a securing device for locking the hatch assembly in a sealed position.

4. The hatch assembly of claim 3 wherein the securing device comprises at least one release handle.

5. The hatch assembly of claim 1 wherein the hatch operating mechanism further includes:

a drive mechanism for activating the extendable assembly and rotational assembly, and an automatic locking mechanism for securing the hatch in a open position.

6. The hatch assembly of claim 5 wherein the drive mechanism is a manual crank handle sprocket assembly.

7. The hatch assembly of claim 5 wherein the drive mechanism is a motor.

8. The hatch assembly of claim 1, wherein the extendable assembly and rotational assembly are included in a telescopic assembly, the telescopic assembly comprising:

an outer cylinder configured in a telescopic relationship with an inner cylinder, a hollow screw fixed to the outer cylinder, a shaft axially inserted within the hollow screw and fixed to the inner cylinder, and a cam fixed to the outer cylinder, said cam slidably disposed in a cam path within a hatch insert operably mounted to the hatch.

9. The hatch assembly of claim 8, wherein the hollow screw is a ball screw.

10. The hatch assembly of claim 8, wherein the shaft is selected from the group consisting of a straight spline, involute spline, recalculating balls, keyed shaft, and polygonal shaft.

11. The hatch assembly of claim 8, further comprising:

a splined bushing, wherein the splined bushing is in operable communication with the shaft.

12. The hatch assembly of claim 8, wherein the cam path comprises:

a first vertical section to raise the hatch followed by a second section to rotate the hatch; and a third vertical section for locking the hatch.

13. A hatch assembly for a portal comprising:

a structure defining the portal;

a hatch positionable over the portal;

an extendable assembly means for advancing the hatch from the portal; and a rotational assembly means for clearing the hatch from the portal.

14. The hatch assembly of claim 13 further including:

a securing device for securing the hatch to the structure, wherein the securing device comprises at least one release handle.

15. The hatch assembly of claim 13, wherein the extendable assembly comprises:

an outer cylinder configured in a telescopic relationship with an inner cylinder, a hollow screw fixed to the outer cylinder, a shaft axially inserted within the hollow screw and a splined bushing, wherein the splined bushing is in operable communication with a shaft.

16. The hatch assembly of claim 15 wherein the rotational assembly means comprises:

a cam fixed to the outer cylinder, wherein the cam is slidably disposed within a cam path.

17. The hatch assembly of claim 16 further comprising:

a hatch insert, wherein the hatch insert contains the cam path and the hatch insert is operably coupled to the hatch.

18. The hatch assembly of claim 17 wherein the cam path includes:

a first vertical section to advance the hatch, followed by a second section to clear the hatch from the portal; and a third vertical section to lock the hatch.

19. The hatch assembly of claim 15, wherein the shaft is selected from the group consisting of a straight spline, involute spline, recalculating balls, keyed shaft, and polygonal shaft.

20. The hatch assembly of claim 16, wherein the hollow screw is a ball screw.

21. The hatch assembly of claim 13 further including a motorized drive mechanism for activating the extendable assembly means and rotational assembly means.

* * * * *

UNITED STATES PATENT AND TRADEMARK OFFICE

CERTIFICATE OF CORRECTION

PATENT NO. : 6,886,447 B2
DATED : May 3, 2005
INVENTOR(S) : Crotty et al.

It is certified that error appears in the above-identified patent and that said Letters Patent is hereby corrected as shown below:

Column 10,
Line 14, delete "means".

Signed and Sealed this

Twelfth Day of July, 2005

JON W. DUDAS
*Director of the United States Patent and Trademark Office*